US005759302A

United States Patent [19]

Nakai et al.

[11] Patent Number: 5,759,302

[45] Date of Patent: Jun. 2, 1998

[54] HEAT TREATABLE AL ALLOYS EXCELLENT IN FRACTURE TOUCHNESS, FATIGUE CHARACTERISTIC AND FORMABILITY

[75] Inventors: Manabu Nakai; Takehiko Eto, both of Kobe, Japan

[73] Assignee: Kabushiki Kaisha Kobe Seiko Sho, Kobe, Japan

[21] Appl. No.: 513,395

[22] Filed: Aug. 10, 1995

[30] Foreign Application Priority Data

Apr. 14, 1995 [JP] Japan ..... 7-089409

[51] Int. Cl.[6] ..... C22C 21/10; C22C 21/12

[52] U.S. Cl. ..... 148/415; 148/416; 148/417; 420/533; 420/541; 420/542; 420/543

[58] Field of Search ..... 148/915, 916, 148/917; 420/529, 533, 534, 535, 537, 541, 542, 543, 546

[56] References Cited

U.S. PATENT DOCUMENTS

| | | | |
|---|---|---|---|
| 4,294,625 | 10/1981 | Hyatt et al. | 148/416 |
| 4,305,763 | 12/1981 | Quist et al. | 148/417 |
| 4,336,075 | 6/1982 | Quist et al. | 148/417 |
| 4,511,632 | 4/1985 | Toma et al. | 420/537 |
| 4,536,075 | 8/1985 | Hoffman | 399/236 |
| 4,569,703 | 2/1986 | Baba et al. | 148/417 |
| 4,711,762 | 12/1987 | Vernam et al. | 420/541 |
| 4,788,037 | 11/1988 | Kaifu et al. | 420/534 |
| 4,894,096 | 1/1990 | Meyer | 148/415 |
| 5,035,754 | 7/1991 | Sakiyama et al. | 148/417 |
| 5,213,639 | 5/1993 | Colvin et al. | 148/417 |
| 5,221,377 | 6/1993 | Hunt et al. | 148/417 |
| 5,376,192 | 12/1994 | Cassada | 420/533 |

FOREIGN PATENT DOCUMENTS

| | | | |
|---|---|---|---|
| 55-500767 A | 10/1980 | Japan . | |
| 56-087647 A | 7/1981 | Japan . | |
| 56-123347 A | 9/1981 | Japan . | |
| 57-82450 | 5/1982 | Japan | 420/535 |
| 58-27947 | 2/1983 | Japan | 420/535 |
| 59-140346 | 8/1984 | Japan | 420/541 |
| 59-182943 | 10/1984 | Japan | 420/529 |
| 60-0155655 | 8/1985 | Japan . | |
| 60-221554 | 11/1985 | Japan | 420/535 |
| 5-339687A | 12/1993 | Japan . | |

*Primary Examiner*—George Wyszomierski

*Attorney, Agent, or Firm*—Oblon, Spivak, McClelland, Maier & Neustadt, P.C.

[57] ABSTRACT

There is provided Al alloys which have improved and excellent fracture toughness and fatigue characteristic and improved formability, and which can be suitably used for transportation machines, such as aircraft, railway vehicles, general mechanical parts and the like. The Al alloy contains 1 to 8% (% by weight, the same is true for the following) of Cu, containing one or more selected from a group comprising 0.4 to 0.8% of Mn, 0.15 to 0.3% of Cr, 0.05 to 0.1% of Zr and 0.1 to 2.5% of Mg, Fe and Si each being less than 0.1%, a distance between constituents being more than 85 μm, and having a micro-structure fulfilling at least one of the following (a) to (c):

(a) the size of Al—Mn dispersoids is 4000 Å or more, (b) the size of Al—Cr dispersoids is 1000 Å or more, and (c) the size of Al—Zr dispersoids is 300 Å or more.

10 Claims, No Drawings

HEAT TREATABLE AL ALLOYS EXCELLENT IN FRACTURE TOUCHNESS, FATIGUE CHARACTERISTIC AND FORMABILITY

BACKGROUND OF THE INVENTION

1. Field of the Invention

The present invention relates to Al alloys suitable for transportation machines, such as for aircrafts, railway vehicles and the like, and general machine parts and the like, and particularly to heat treatable Al alloys which exhibit excellent fracture toughness, fatigue characteristic and formability.

2. Description of the Related Art

Heat treatable Al alloys are used as parts for which particularly high values of fracture toughness and fatigue characteristics are required, for example, for aircrafts, railway vehicles and the like using rivet joints. Particularly, heat treatable Al alloys are used for the construction of the body of commercial aircrafts, a monocoque construction in which outer places are joined to longitudinal ribs mainly using rivets. A passenger cabin of the body is maintained at atmospheric pressure close to that on the ground, even at a high altitude, and therefore, higher pressure than open air is applied thereto. Therefore, at the high altitude, for example, tensile tension in a circumferential direction of the body acts on the section of the outer plate of the body so that a periodic tensile tension it generated by the movement to and from the ground. Generally, the periodic tensile tension is said to be applied approximately 100,000 times until the commercial aircraft reaches the end of its life. Further, the periodic tensile tension is also generated in wing face places as a result of movement between air and ground. The aforesaid periodic tensile tension sometimes leads to the occurrence and propagation of fatigue and crevices about the rivet holes, and to fractures, all for the worst.

Al alloys used as the main materials for the aircraft include, for example, heat treatable Al—Cu alloys and heat treatable Al—Cu—Mg Al alloys for the outer plate and the wing lower face plate of the body, and heat treatable Al—Zn—Mg Al alloys for the wing upper face plate. Further, materials for brackets and the like mainly include heat treatable Al—Mg—Si Al alloys. Since in the aforementioned heat treatable Al—Cu alloys and heat treatable Al—Cu—Mg Al alloys, the precipitation free zone (PFZ) along the grain boundary exhibits the most base potential with respect to the intergranular and grain boundary precipitation, the PFZ is sometimes preferentially dissolved in a corrosive atmosphere to produce corrosion of the grain boundaries. Because of this, for example, in the fuselage skins of commercial aircraft, a clad product of Al of 99.3% purity or more as a skin material and the aforesaid alloy as core alloys are used so that excellent corrosion protecting is obtained by sacrificial anodic action caused by the pure Al.

Similar to the above, the heat treatable Al—Zn—Mg Al alloys are generally used as a clad products with a 7072 alloy, which is an Al alloy containing about 1.0% of Zn or the heat treatable Al—Zn—Mg alloys which do not contain Cu, being the clad alloy. In the heat treatable Al—Mg—Si Al alloys, Cu may be sometimes positively added to enhance the strength, but this brings forth a deterioration of the corrosion protection similar to the heat treatable Al—Cu Al alloys. For this reason, it is necessary that pure Al is used as the clad alloy, depending on the amount of Cu added, to provide a clad product.

On the other hand, recently, also in railway passenger vehicles, attempts have been made to realize a reduction in weight for increased speed. A light-weight vehicle in which shape materials or plate materials of Al alloy are joined by welding has been put forth for practical use. In order to meet the requirements of a further reduction in weight and an increase in speed, some light-weight vehicles have been studied in which the heat treatable Al—Cu—Mg Al alloys are used as the outer plate, employing the monocoque construction—rivet joining similar to commercial aircraft.

However, in the vehicles, at the time of moving in and out of a tunnel or at the time of passing another vehicle, a great pressure difference is generated. The number of times this pressure difference is generated eventually reaches about 10,000,000 times, so in a vehicle having rivet joinings, there gives rise to a problem in that fatigue and crevices from the rivet holes tend to occur and propagate.

In the field of the commercial aircraft, airline companies intended to reduce the operation cost by employing larger aircraft, extending service life and the like, in order to compete against other companies. For this reason, the airline companies desire to enhance the durability of the body construction, as compared with conventional aircraft or aircraft expected to be developed in the future. For example, there is a desire to develop materials with excellent fracture toughness and fatigue characteristics, as compared with the prior art, for the outer places and wing face materials of the body. Further, also with aircraft makers, attempts have been made to reduce the fabrication cost of the body. In the molding of materials, it is necessary to reduce or omit the number of steps of polishing surfaces of the products after molding, for example. It is desirable that the roughness of materials for aircraft, such as an orange peel-like surface, be reduced or eliminated. In terms of microtissue structure, materials excellent in formability having fine grains are desired.

On the other hand, also in the field of railway vehicles, in order to cope with the development of light-weight vehicles having rivet joints, development of materials excellent in fracture toughness and fatigue characteristics, as compared with the existing materials, is a pressing need. Further, recent vehicles have more complicated shapes than the conventional vehicless, in order to realize an optimal shape in terms of design or aeromechanics. Therefore, in parts which require a large amount of molding processes, inferior forming, such as the aforementioned orange peel-like surface, sometimes occurs. It is therefore necessary for the railway vehicles, similar to aircraft, to have materials excellent in formability having fine grains.

Meanwhile, the heat treatable Al—Cu—Mg Al alloy, such as 2014 alloy, 2017 alloy, 2024 alloy and the like, are used for general mechanical parts, for example, such as gears, hydraulic parts and hubs for bicycles. Also in these general mechanical parts, attempts have been made to enhance the reliability of the products by improving the fracture toughness and fatigue characteristics and to reduce thickness and weight. Furthermore, in order to enhance the design of the products, materials excellent in formability by having finer crystallized grains, are required.

SUMMARY OF THE INVENTION

The present invention has been accomplished under the aforementioned situation. An object of the present invention is to provide an Al alloy having improved and excellent fracture toughness and fatigue characteristics and also improved formability, which is suitable for use in transportation machines such as aircraft, railway vehicles and the like, as well in as general mechanical parts.

The present invention provides heat treatable Al alloys excellent in fracture toughness, fatigue characteristics and formability, containing 1 to 8% of Cu, containing one or more members selected from a group comprising 0.4 to 0.8% of Mn, 0.15 to 0.3% of Cr, 0.05 to 0.1% of Zr and 0.1 to 2.5% of Mg, Fe and Si each being less than 0.1%, a distance between constituents being more than 85 μm, and having a micro-structure having at least one of the following (a) to (c):

(a) the size of Al—Mn dispersoids is 4000 Å or more, (b) the size of Al—Cr dispersoids is 1000 Å or more, and (c) the size of Al—Zr dispersoids is 300 Å or more.

Further, the object of the present invention can be achieved by Al alloys having either of the following chemical component compositions ① and ②, a distance between constituents being 85 μm or more, and a structure having at least one of the above (a) to (c):

① a heat treatable Al alloy containing 0.1 to 10% of Zn and 0.1 to 3.5% of Mg, containing one or more members selected from a group comprising 0.4 to 0.8% of Mn, 0.15 to 0.3% of Cr, 0.05 to 0.1% of Zr and 0.1 to 3% of Cu, Fe and Si each being less than 0.1%, and ② a heat treatable Al alloy containing 0.2 to 2% of Mg and 0.1 to 1.5% of Si, and containing one or more members selected from a group comprising 0.4 to 0.8% of Mn, 0.15 to 0.3% of Cr, 0.05 to 0.1% of Zr and 0.05 to 1.0% of Cu, Fe being less than 0.1%.

In producing the above-described each heat treatable Al alloys of the present invention, particularly when cold working (for example, cold rolling) is omitted, hot working (for example, hot rolling) in the producing steps is preferably carried out in a range of temperatures of from 410° to 210° C., more preferably, a deformation starting temperature of 410° or less, and a deformation terminating temperature of 210° to 250° C., then, the heat treatable Al alloys having finer grains in the final product are obtained, providing superior fracture toughness, fatigue characteristics and formability.

It is known as a general fact that in high strength Al alloys, the fracture toughness is reduced as the strength increases, and with respect to the micro-structure, the fracture toughness is reduced as the volume fraction of the constituents increases. Typical examples of constituents include $Al_7Cu_2Fe$, $Al_{12}(Fe, Mn)_3Cu_2$, $(Fe, Mn)A_{15}$, $Al_{12}CuMg$, $Al_2Cu$, $Mg_2Si$, etc., containing Cr and Zr, depending on the alloy system. As a result of repeated studies on the relationship between the micro-structure and mechanical properties made by the present inventor, it has been found that the fracture toughness is not merely affected by the volume fraction of the constituents, but is improved in proportion to a square root of the distance between particles of the constituents, having the size of a few μm observed in a center portion of a dimple on the fractures surface. It has also been found that the fatigue characteristic is improved by making the distance between the constituents longer.

The present inventors have further earnestly repeated their studies on the relationship between the micro-structure and mechanical properties, even after the knowledge described above was obtained. As a result, it has been found that in a heat treatable Al alloy having a predetermined chemical composition, if in the state where the distance between the constituents is 85 μm or more, the size of at least one of the dispersoids of Al—Mn, Al—Cr and Al—Zr systems are made larger than 4000 Å, 1000 Å and 300 Å, respectively, the dispersoids provide a marked resistance with respect to the propagation of fatigue cracks and the fatigue crack growth rate can be reduced, and the distance between the constituents is made 85 μm or more to thereby improve the fracture toughness, and in addition, if the hot working is applied under the predetermined condition, excellent formability can be obtained, thus completing the present invention. It is known that $Al_{20}Cu_1Mn_3$, $Al_{12}Mg_2Cr$ and $Al_3Zr$ are typical in Al—Mn dispersoids, Al—Cr dispersoids and Al—Zr dispersoids, respectively.

If the distance between the constituents is less than 85 μm, even if the size of the dispersoids is made large as described above, the constituents themselves comprise the trace of a fatigue crack or a new starting point, and therefore, the significant reduction in the fatigue crack growth rate cannot be expected.

The chemical composition of the Al alloys according to the present invention will now be described. First, objects of the heat treatable Al alloys according to the present invention are, from the viewpoint of obtaining high strength by way of age hardening, an alloy containing 1% or more of Cu as a basic component (Al alloys of claim 1, hereinafter referred to as "heat treatable Al—Cu Al alloys"), an alloy containing 0.1% or more of Zn and 0.3% or more of Mg as a basic component (Al alloys of claim 2, hereinafter referred to as "heat treatable Al—Zn—Mg Al alloys"), and an alloy containing 0.2% or more of Mg and 0.1% or more of Si as a basic component (Al alloys of claim 3, hereinafter referred to as "heat treatable Al—Mg—Si Al alloys").

In the heat treatable Al—Cu Al alloys, 0.1% or more of Mg is added to the heat treatable Alloys, if necessary, to further improve the age hardening properties. In the heat treatable Al—Zn—Mg Al alloys, 0.1% or more of Cu is added, if necessary. In the heat treatable Al—Mg—Si Al alloys, 0.05% or more of Cu is added, if necessary.

In the above-described Al alloys of the respective component systems, Fe and Si produce the constituents such as $Al_7Cu_2Fe$, $Al_{12}(Fe, Mn)_3Cu_2$, $(Fe, Mn)Al_6$, $Al_2CuMg$, $Al_2Cu$, $Mg_2Si$, etc. Since these constituents are harmful with respect to the fracture toughness and fatigue characteristic, the amounts added thereof are controlled as follows according to the respective components. Among the above-described constituents, $Al_7Cu_2Fe$, $Al_{12}(Fe, Mn)_3Cu_2$, $(Fe, Mn)Al_6$, etc. are insoluble constituents, and if they are produced, they are hardly subjected to dissolution again into the mother phase, even by heat treatment. When a large amount of constituents are produced, Cu, Mg, Si and the like, which are components of separated substances for causing the product strength to increase by age hardening, are partly consumed as the components of the constituents, thus lowering the product strength. Since in the present invention, the Al alloys having excellent fracture toughness and fatigue characteristic and high strength are realized, it is controlled so that in any of the Al—Cu, Al—Zn—Mg and Al—Mg—Si systems, the amount of Fe added is less than 0.1%; in the Al—Cu and Al—Zn—Mg systems, the amount of Si added is less than 0.1%, and in the Al—Mg—Si system, the amount added is less than 1.5%.

Further, Cu and Mg are components controlled to produce constituents such as $Al_7Cu_2Fe$, $Al_{12}(Fe, Mn)_3Cu_2$, $Al_2Cu_2Mg$, $Al_2Cu_2$, $Mg_2Si$, etc., and the upper limit of the amount added is controlled as follows according to the respective components, so that the distance between the constituents is 85 μm or more. In the Al alloys of the present invention, the composition is as follows: in the Al—Cu system, Cu:8% or less (in the case of an alloy containing Mg, when necessary, Mg:2.5% or less); in the Al—Zn—Mg system, Mg:3.5% or less (in the case of an alloy containing Cu, when necessary, Cu:0.3% or less); and in the Al—Mg—

Si system, Mg:2% or less (in the case of an alloy containing Cu, when necessary, Cu: 1.0% or less), respectively. In the Al—Zn—Mg system, the amount of Zn is 10% or less from the viewpoint of the lowering of corrosion protecting.

On the other hand, Mn, Cr, Zr, etc. are elements participated in the production of dispersoids at the time of the homogenizing heat treatment and at the time of the subsequent hot rolling. These dispersoids are necessary for the production of fine grains, since the former impede the movement of grain boundary after recrystallization. Particularly, in the present invention, the size of at least one of the dispersoids of Al—Mn, Al—Cr and Al—Zr systems is made larger than 4000 Å, 1000 Å and 300 Å, respectively, so the dispersoids act to resist the propagation of fatigue crack to reduce the fatigue crack growth rate. It is necessary to exhibit the aforesaid effect, to set the amounts of Mn, Cr and Zr added to 0.4% or more, 0.15% or more and 0.05% or more, respectively.

However, the addition of too much of these elements, such as Mn, Cr and Zr, tends to produce a coarse insoluble intermetal compound at the time of dissolution and casting, resulting in deterioration of the formability. Further, particularly, the addition of too much Zr tends to make the micro-structure fibrous, deteriorating the fracture toughness and fatigue characteristic in a specific direction and the formability. It is therefore necessary that the amounts of Mn, Cr and Zr added be controlled, in any component system, to 0.8% or less, 0.3% or less and 0.1% or less, respectively.

The elements such as Mn, Cr and Zr may be selectively added, but the kind of particles to be dispersed should be adequately selected according to the component systems. For example, in the heat treatable Al—Cu Al alloys, when the $Al_{12}Mg_2Cr$ particles are desired to be dispersed, Cr may be combined with Mg to be added, when necessary. Further, for example, in the Al—Zn—Mg Al alloys, when the $Al_{20}Cu_2Mn_3$ particles are desired to be dispersed, Mn may be combined with Cu to be added, when necessary. In short, the kind and amount of added elements such as Mn, Cr and Zr may be adequately selected according to the component systems so as to fulfill at least one (a) to (c):

(a) The size of Al—Mn dispersoids is 4000 Å or more (b) the size of Al—Cr dispersoids is 1000 Å or more, and (c) the size of Al—Zr dispersoids is 300 Å or more.

The chemical composition of the Al alloys according to the present invention is provided from the viewpoint described above.

However, the Al alloys according to the present invention may contain elements such as Ti, V and Hf, if necessary. These elements make the cast lump composition finer, but they are controlled to be present in an amount of less than 0.3% from the viewpoint of deterioration of the formability.

The Al alloys according to the present invention can be produced, for example, by making a cast lump by dissolution and casting, applying homogenization anneal, hot rolling and further cold rolling, if necessary, water quenching, reforming by way of rolls or stretcher, and aging, in that order.

Preferably, in the dissolution and casting in the above-described producing steps, a hydrogen concentration in the molten metal is reduced as low as possible by degassing prior to casting. Since hydrogen contained in molten metal has an extremely low solubility in the Al alloys, microporosity is formed during casting, and remains as a small cavity in the final product. This cavity acts as a starting point for fracture and will cause a reduction of the fracture toughness and fatigue characteristic of the products. Particularly, in the products which are low in the degree of word, the microporosity does not fracture, but tends to remain in the cavity. Therefore, it is recommended that the concentration of hydrogen gas in molten metal is preferably less than 0.05 cc/100 mlAl, more preferably 0.02 cc/100 mlAl.

The greatest factor for deteriorating the fracture toughness and fatigue characteristic are constituents. If the distance between the constituents as shown in the present text can be made large, degassing may be carried out in the conventional manner. Further, the casting method may be a semi-continuous casting method or a continuous casting rolling method. High speed casting, including the continuous casting rolling method, makes the constituents finer and the distance between the particles of coarse constituents longer. Therefore, the fracture toughness is remarkably enhanced. The homogenization anneals are carried out to make the constituents, which are harmful to the fracture toughness and fatigue characteristic, re-dissolve, and to make the distance between the constituents longer than 85 μm. Particularly, the heat treatment step is important to positively make the constituents, such as $Al_2CuMg$, $Al_2Cu$, $Mg_2Si$, etc., re-dissolve. Further, the homogenization anneals are also effective to make the sizes of dispersoids of the Al—Mn, Al—Cr and Al—Zr systems, which improves the fatigue characteristic, larger than 4000 Å, 1000 Å and 300 Å, respectively.

The optimal temperatures and time for the homogenization anneals are as follows. First, in the case of the heat treatable Al—Cu Al alloys, it is necessary to apply the heat treatment for four hours or more at 450° C. or more to a cast lump. A temperature of 450° C. or less is too low to make the distance between constituents large and the size of dispersoids large. At a temperature above 485° C., it is difficult to obtain dispersoids of the size necessary to improve the fatigue characteristic, because part of the dispersoids dissolve. The eutectic temperature of Al—$Al_2Cu$—$Al_2CuMg$ is 508° C. When this temperature is exceeded local melting sometimes occurs. For carrying out the homogenizing heat treatment immediately below 508° C., heating should be done at an extremely slow rate so as not to surpass 508° C., which is not practical in production. Therefore, preferably, the homogenization anneals are done for eight hours or more at 450° to 485° C.

Further, in the case of the heat treatable Al—Zn—Mg Al alloys, it is necessary heat-treat a cast lump for four hours or more, preferably at a temperature of 450° C. or more. A temperature of 450° C. or less is too low to make the distance between constituents large and the size of dispersoids large. Further, at a temperature above 530° C., it is difficult to obtain dispersoids of the size necessary to improve fatigue characteristic, because part of the dispersoids are dissolved. Therefore, preferably, the homogenization anneals are done for four hours or more at 450° to 530° C.

Further, in the case of the heat treatable Al—Mg—Si Al alloys, it is necessary to apply heat treatment for four hours or more to a cast lump, preferably at a temperature of 450° C. or more. A temperature of 450° C. or less is too low to make the distance between constituents large and the size of dispersoids large. Further, at a temperature above 560° C., it is difficult to obtain dispersoids of the size necessary for improving fatigue characteristic, because part of the dispersoids are dissolved. Therefore, preferably, the homogenization anneals are done for four hours or more at 450° to 560° C.

In producing a combined material using the Al alloys of the present invention as core alloys and the pure Al or 7072 alloy as clad alloys, preferably, the core alloys and the skin layers are separately subjected to homogenizing heat treatment, and after this both sides or one side of the core alloys are covered with the clad alloys, after which the resultant material is subjected to hot rolling to provide clad products. This decreases diffusion of the components of the material, such as Cu, Mg, Zn and the like, into the clad alloys to prevent deterioration of corrosion resistance.

In the hot rolling, preferably, both the temperature of the inlet and outlet sides of the hot rolling are lowered to increase the amount of work hardening introduced during rolling so that the grains of the final product and the elongated particles are formed into a regular system. This is particularly effective for the product for which cold rolling after hot rolling has been omitted. The fracture toughness, fatigue characteristic and strength are improved by making the grains finer, and roughness such as an orange peel-like surfaces, which occurs during forming, can be prevented, thus also improving the formability.

The hot rolling is preferably started at 410° C. or less after a cast lump has been removed from a furnace after the completion of the homogenizing heat treatment. When the hot rolling starts at a temperature above 410° C. (a deformation start temperature), the restoring amount during rolling increases and the work hardening amount greatly decreases. If the temperature of the outlet side of the hot roller (a deformation termination temperature) exceeds 250° C., recrystallization becomes completed so that particle growth tends to occur during cooling. Particularly, in the product for which heat a treatment, such as a solution heat treatment, is carried out, and cold rolling is omitted in the subsequent producing step, particle growth tends to occur even during heat treatment. Further, when the temperature of the outlet side of the hot roller is 210° C. or less, marked rolling scratches tend to occur on the rolling surface. Therefore the temperature of the outlet side of the hot roller is preferably 210° to 250° C. Sometimes, recrystallization terminates even at temperatures of 210° to 250° C., depending on the hot rolling conditions. In short, it is important to still have the working structure, even at the termination of hot rolling.

A rolled plate, after completion of hot rolling, is subjected to cold rolling, if necessary, after which solution heat treatment and hardening are carried out. The heat treatment furnaces used in this case may be a batch furnace, a continuous annealing furnace or a melt salt bath furnace. Further, hardening may be carried out by a water dipping, water jetting or air jetting. The solution heat treatment and the hardening are carried out in accordance with the convention method to make the soluble intermetallic compounds re-dissolve and to sufficiently suppress re-separation during cooling. However, when the material of the present invention is used in aircraft, the above treatment is preferably carried out in accordance with the conditions as set forth in MIL-H-6088F.

It is recommended that the rate of temperature increase be maintained at 5° C./min or more in order to obtain fine grains excellent in fracture toughness and fatigue characteristic, while preventing crystallized particles produced during the temperature rise to the treatment temperature from becoming coarse.

Quenched material is subjected to cold working with an elongation conversion value of up to the maximum 10% using a cold rolling mill and a stretcher, for the purpose of correcting strain during hardening and increasing the durability of the final product. Further, the product is naturally aged or artificially aged.

Grains were observed, after solution heat treatment and quenching. A position about 0.05 to 0.1 mm from the surface of the product was observed. Grain sizes were measured by a line intercept method in an L direction. The line length per measurement was 500 μm, and the total line length of measurement was 500×25 μm by five field-view observations each 5 per field view. In the case of clad products, a position about 0.05 to 0.1 mm from the surface of the core alloys was observed.

Constituents (≧1.8 $\mu m^2$), including Fe, Si, Cu and the like, were observed by SEM (a component analyzer and an image processor) after solution heat treatment and quenching. The distance between the constituents was measured by the line intercept method (L-ST surface). A line length per measurement was 220 μm and 175 μm in the L and ST directions, respectively. The total measurement line length was 220×50 μm and 175×50 μm by 10 field view observations each 5 per field view, and the distances between the constituents in the L and ST directions were averaged to provide a distance between constituents set forth in the present patent. In the case of clad products, the distance between the constituents was measured at a section of the core alloys. Naturally, if the size of the constituents to be selected is less than 1.8 $\mu m^2$, the distance between the constituents would decrease.

Dispersoids were observed by TEM (a component analyzer and an image processor) after solution heat treatment and quenching. The size of the dispersoids is an average of the maximum length of each particle, and an average value at 20 view fields was employed as the size of dispersoids set forth in the present patent. In the case of clad products, the core alloys were observed. In the case where the distribution of dispersoids was evaluated, not on the basis of the maximum length of each particle, but rather on the basis of the area of each particle or the distance between the particles, the coarseness of the particles was measured as an increase of the area and an enlargement of the distance.

A tensile test was conducted in the tensile direction of LT and at the tensile speed of 5 mm/min in the normal temperature atmosphere in accordance with ASTM-E8 after room temperature aging or artificial aging. The fracture toughness Kc was measured in accordance with ASTM-E561 and B646, and the fatigue crack growth rate was measured in accordance with ASTM-E647. The fatigue crack growth rate is a value determined in the present patent with ΔK=constant, and an average speed of crack half length of 10 to 25 mm. The ΔK value and the details of test direction are shown in the Examples. The value of mechanical characteristics shown in the Examples shows the minimum value among three tests.

The Al alloys according to the present invention are basically excellent in fracture toughness and fatigue characteristic. However, the hot working in the producing steps of Al alloys are carried out preferably at 410° to 210° C., more preferably at 410° C. or less for the deformation start temperature and at 210° to 250° C. for the deformation termination temperature, whereby the grains of the final product are made finer to provide excellent fracture toughness and fatigue characteristic as well as formability. The Al alloys of the present invention can be applied as malleable heat treatable Al alloys. Of course, the final products may be a plate, shaped material or forged material.

The present invention provides heat treatable Al alloys which have improved fracture toughness, fatigue characteristic, as well as formability. The heat treatable Al alloys can be used for transportation machines such as aircraft and railway vehicles and mechanical parts.

DESCRIPTION OF THE PREFERRED EMBODIMENTS

While the present invention will be described in detail by way of examples, it is to be noted that the following examples are not intended to limit the present invention, and changes may be made in the design in the light of the subject matter previously described, or described later in the examples, which are also included in the technical scope of the present invention.

EXAMPLE 1

An ingot containing, in accordance with the invention, 3.9% Cu, 1.5% Mg, 0.6% Mn, 0.04% Fe, 0.04% Si, and the balance Al, was cast. The metal (hereinafter called "core alloy") having a thickness of 460 mm was subjected to a homonization anneal.

After both surfaces of the core allay was chamfered, both surfaces of the core alloy were clad with AA1050 to provide a clad product having a thickness of 420 mm. The clad product was taken out of a furnace immediately after being reheated up to 380° C., and subjected to hot rolling to a thickness of 4.0 mm at a start temperature of 350° C. and a termination temperature of 220° C., followed by cold rolling to a thickness of 2.5 mm. The obtained cold rolled material was quenched in water immediately after solution heat treating for 40 minutes at 494° C. and applied with a permanent tensile deformation of 2%, after which room temperature aging was conducted for three weeks.

The following Table 1 shows the influence on the micro-structure and mechanical properties of T3 material by the concentration of hydrogen in molten metal and the soaking conditions. The micro-structure was observed using the core material after water quenching.

As will be apparent from Table 1, Examples ① and ② and ③ of the present invention have high fracture toughness and a low fatigue crack growth rate, showing excellent characteristic values as compared with Comparative Examples ④ to ⑥.

Reference Example

An Al alloy containing Cu: 3.9%, Mg: 1.5%, Mn: 0.6%, Fe:0.04% and Si: 0.04% and the remainder impurities was subjected to dissolution casting after degassing to a concentration of hydrogen of 0.02 cc/100 mlAl in the molten metal to provide a cast lump (hereinafter called "core material") having a thickness of 400 mm.

Subsequently, soaking treatment for 36 hours at 480° C. was applied, and after both surfaces of the core material were chamfered, both surfaces of the core material were clad with AA1050 (hereinafter called "skin material") to provide a combined material having a thickness of 360 mm. The combined material was taken out of a furnace immediately after being reheated up to a temperature about 20° C. higher than a hot rolling start temperature shown in the following Table 2 and subjected to hot rolling to a thickness of 2.5 mm. The obtained hot rolled material was quenched in water immediately after solution heat treatment for 50 minutes at 494° C. and applied with a permanent tensile deformation of 2%, after which room temperature aging was conducted for three weeks.

The following Table 2 shows the influence on the flaw on the surface of the hot rolled material, the micro-structure, the surface shape and mechanical properties of T3 material by the hot rolling conditions. The micro-structure was observed after water quenching.

As will be apparent from Table 2, ① and ② under the preferable producing conditions are free of the surface flaws of hot rolling material as compared with ③ and ④, and since the grain size of the skin material and core material are small, no orange peel-like surface occurs. Particularly, since the grain size of the care material is small, and even in strength, fracture toughness and fatigue crack growth rate, ① and ② under the preferable producing conditions indicate excellent characteristics as compared with ③ and ④.

TABLE 1

| | Hydrogen concentration in molten metal (cc/100 ml Al) | Soaking Conditions Temp. (°C.) | Soaking Conditions Time (hr) | Core Alloy[1] Distance between constituents (μm) | Core Alloy[1] Size of dispersoids (Å) | Mechanical Properties of clad product (T3) Yield strength LT (N/mm²) | Fracture toughness T-L (ksi√in) | [3]Fatigue crack growth rate T-L ΔK30 ksi√in (inch/cycle) |
|---|---|---|---|---|---|---|---|---|
| ①Example 1 | 0.02 | 480 | 36 | 150 | 5500 | 320 | 165 | $1.0 \times 10^{-4}$ |
| ②Example 2 | 0.03 | 460 | 12 | 140 | 4500 | 315 | 155 | $1.2 \times 10^{-4}$ |
| ③Example 3 | 0.06 | 480 | 36 | 148 | 5300 | 320 | 145 | $1.3 \times 10^{-4}$ |
| ④Comparative Example 2 | 0.03 | 480 | 6 | 130 | 3500 | 315 | 155 | $1.6 \times 10^{-4}$ |
| ⑤Comparative Example 3 | 0.03 | 430 | 48 | 115 | 2500 | 320 | 140 | $2.1 \times 10^{-4}$ |
| ⑥Comparative Example 4 | 0.03 | 500 | 36 | 150 | 3500 | 315 | 155 | $1.8 \times 10^{-4}$ |

[1]Microstructure after water quenching
[2]In compliance with ASTM E561, B646 (Test piece with a central hole, width of test piece; 406 mm)
[3]In compliance with ASTM E647 (specimen Type: CCT, width of test piece; 102 mm, R.H. ≧ 90%, R-Ratio = 0.1, frequency 1 HZ)

TABLE 2

| | Hot Rolling Conditions | | [1]Presence | [1]grain size | | Surface Shape and Mechanical Properties of Clad product (T3) | | | |
|---|---|---|---|---|---|---|---|---|---|
| | Start Tempera-ture (°C.) | Terminal Tempera-ture (°C.) | of flaw on surface of hot roll material | Skin alloy $d_L$ (μm) | Core alloy $d_L$ (μm) | [3]Occur. of orange peel-like surface | Yield strength LT (N/mm²) | [4]Fracture toughness T-L (ksi√in) | [5]Fatigue crack growth rate T-L ΔK30 ksi√in (inch/cyc.) |
| ①Ref. Examp. 1 | 380 | 220 | ○ | 40 | 35 | ○ | 318 | 162 | $1.1 \times 10^{-4}$ |
| ②Ref. Examp. 2 | 400 | 240 | ○ | 50 | 40 | ○ | 316 | 155 | $1.3 \times 10^{-4}$ |
| ③Ref. Examp. 3 | 470 | 200 | Δ | 50 | 40 | ○ | 315 | 155 | $1.3 \times 10^{-4}$ |
| ④Ref. Examp. 4 | 400 | 260 | ○ | 70 | 60 | Δ | 310 | 150 | $2.0 \times 10^{-4}$ |

[1),3)]○: None, Δ: often occur
[2)]Microstructure after water quenching
[4)]In compliance with ASTM E561, B646 (Test piece with a central hole, width of test piece; 406 mm)
[5)]In compliance with ASTM E647 (specimen Type: CCT, width of test piece; 102 mm, R.H. ≧ 90%, R-Ratio = 0.1, frequency 6 1 HZ)

EXAMPLE 2

Ingots having the following chemical compositions ① to ⑤ ware cast after degassing to a concentration of hydrogen 0.02 cc/100 mlAl as molten metal.

① Al alloy containing Cu: 3.9%, Mg: 1.5%, Mn: 0.6%, Fe: 0.04%, and Si: 0.04% and the remainder impurities and Al, ② Al alloy containing Cu: 4.2%, Mg: 1.5%, Mn 0.6%, Fe: 0.07%, and Si: 0.04% and the remainder impurities and Al, ③ Al alloy containing Cu: 4.6%, Mg: 1.5%, Mn: 0.6%, Fe: 0.07%, and Si: 0.04% and the remainder impurities and Al, ④ Al alloy containing Cu: 4.2%, Mg: 1.5%, Mn: 0.6%, Fe: 0.12%, and Si: 0.04% and the remainder impurities and Al, and ⑤ Al alloy containing Cu: 4.2%, Mg: 1.5%, Mn: 0.6%, Fe: 0.07%, and Si: 0.15% and the remainder impurities and Al.

The metals (hereinafter called "core alloy") having a thickness of 460 mm were soaked for 36 hours at 480° C., and after both surfaces of the core alloys were chamfered, both surfaces of the core alloys were clad with AA1050 (hereinafter called "skin material") to provide clad products having a thickness of 420 mm. The clad products were taken out of a furnace immediately after being reheated up to 380° C., and subjected to hot rolling to a thickness of 4.0 mm at a start temperature of 350° C. and a termination temperature of 220° C. followed by cold rolling to a thickness of 2.5 mm. The obtained cold rolled materials were quenched in water immediately after solution heat treating for 40 minutes at 494° C. and applied with a permanent tensile deformation of 2%, after which room temperature aging was conducted for three weeks.

The following Table 3 shows the influence on the micro-structure and mechanical properties of T3 material by the chemical components of the core alloy. The micro-structure was observed using the core alloy after water quenching.

As will be apparent from Table 3, Examples ① and ② of the present invention have high fracture toughness and a low fatigue crack growth rate, showing excellent characteristic values, as compared with Comparative Examples ③ and ④.

TABLE 3

| | Chemical Component of core alloy | | Microstructure of 1) core alloy | | Mechanical Properties of clad Product (T3) | | |
|---|---|---|---|---|---|---|---|
| | Cu (wt. %) | Fe (wt. %) | Distance between constituents (um) | Size of dispersoids (Å) | Yield strength LT (N/mm²) | [2]Fracture toughness T-L (ksi√in) | [3]Fatigue crack growth rate ΔK30 ksi√in (inch/cycle) |
| ①Example 1 | 3.9 | 0.04 | 150 | 5500 | 320 | 165 | $1.0 \times 10^{-4}$ |
| ②Example 2 | 4.2 | 0.07 | 110 | 5300 | 315 | 140 | $1.2 \times 10^{-4}$ |
| ③Comp. Example 1 | 4.6 | 0.07 | 80 | 5400 | 325 | 120 | $2.5 \times 10^{-4}$ |
| ④Comp. Example 2 | 4.2 | 0.12 | 50 | 5200 | 320 | 110 | $2.6 \times 10^{-4}$ |

1)Microstructure after water quenching
[2)]In compliance with ASTM E561, B646 (Test piece with a central hole, width of test piece; 406 mm)
[3)]In compliance with ASTM E647 (Specimen Type: CCT, width of test piece; 102 mm, R.H. ≧ 90%, R-Ratio = +0.1, frequency 1 Hz)

EXAMPLE 3

Ingots having the following chemical compositions ① to ⑤ were cast after degassing to a concentration of hydrogen 0.02 cc/100 mlAl as molten metal to provide a cast lump (hereinafter called "core material") having a thickness of 460 mm.

① Al alloy containing Cu: 3.9%, Mg: 1.5%, Mn: 0.6%, Fe: 0.04%, and Si: 0.04% and the remainder impurities and Al, ② Al alloy containing Cu: 3.9%, Mg: 1.5%, Mn: 0.7%, Fe: 0.04%, and Si: 0.04% and the remainder impurities and Al, ③ Al alloy containing Cu: 3.9%, Mg: 1.5%, Mn: 0.4%, Fe: 0.04%, and Si: 0.04% and the remainder impurities and Al, ④ Al alloy containing Cu: 4.2%, Mg: 1.5%, Mn: 0.9%, Fe: 0.12%, and Si: 0.12% and the remainder impurities and Al, and ⑤ Al alloy containing Cu: 4.2%, Mg: 1.5%, Mn: 0.6%, Fe: 0.12%, and Si: 0.12% and the remainder impurities and Al.

The metals (hereinafter called "core alloy") were soaked for 36 hours at 480° C., and after both surfaces of the core alloys were chamfered, both surfaces of the core alloys were clad with AA1050 to provide clad products having a thickness of 420 mm. The clad products were taken out of a furnace immediately after being reheated up to 380° C., and subjected to hot rolling to a thickness of 4.0 mm at a start temperature of 350° C. and a termination temperature of 220° C. followed by cold rolling to a thickness of 2.5 mm. The obtained cold rolled material was quenched in water immediately after solution heat treating for 40 minutes at 494° C. and applied with a permanent tensile deformation of 2%, after which room temperature aging was conducted for three weeks.

The following Table 4 shows the influence on the micro-structure and mechanical properties of T3 material by the chemical components of the core alloy. The micro-structure was observed using the core alloy after water quenching.

As will be apparent from Table 4, Examples ① and ② of the present invention have high fracture toughness and a low fatigue crack growth rate, showing excellent characteristic values, as compared with Comparative Examples ③ to ⑤.

TABLE 4

| | Chemical Component of core alloy | | | Microstructure of core material 1) | | Mechanical characteristics of clad material (T3) | | | |
|---|---|---|---|---|---|---|---|---|---|
| | | | | | | | | 3)Fatigue crack growth rate | |
| | Cu (wt. %) | Fe (wt. %) | Mn (wt. %) | Distance between constituents (μm) | Size of dispersoids (Å) | Yield strength LT (N/mm²) | 1)Fracture toughness T-L (ksi√in) | ΔK22 ksi√in (inch/cycle) | ΔK30 ksi√in (inch/cycle) |
| ①Example 1 | 3.9 | 0.04 | 0.60 | 150 | 5500 | 320 | 165 | $1.0 \times 10^{-5}$ | $1.0 \cdot 10^{-4}$ |
| ②Example 2 | | | 0.70 | 155 | 6000 | 325 | 165 | $0.9 \times 10^{-5}$ | $0.9 \times 10^{-4}$ |
| ③Comp. Example 1 | | | 0.40 | 150 | 3000 | 300 | 150 | $1.4 \times 10^{-5}$ | $1.8 \times 10^{-4}$ |
| ④Comp. Example 2 | 4.2 | 0.12 | 0.90 | 55 | 8000 | 330 | 120 | — | $1.5 \times 10^{-4}$ |
| ⑤Comp. Example 3 | | | 0.60 | 50 | 5200 | 320 | 110 | — | $2.6 \times 10^{-4}$ |

1)Microstructure after water quenching
2)In compliance with ASTM E561, B646 (Test piece with a central hole, width of test piece; 406 mm)
3)In compliance with ASTM E647 (Specimen Type: CCT, width of test piece; 102 mm, R.H. ≧ 90%, R-Ratio = +0.1, frequency 1 Hz)

EXAMPLE 4

Ingots having the following chemical compositions ① to ③ were cast after degassing to a concentration of hydrogen 0.02 cc/100 mlAl as molten metal.

① Al alloy containing Zn: 5.4%, Mg: 2.5%, Cu: 1.8%, Zr: 0.09%, Fe: 0.05%, Si:0.05% and the remainder impurities and Al, ② Al alloy containing Zn: 5.4%, Mg: 2.5%, Cu: 1.8%, Zr: 0.03%, Fe: 0.05%, Si: 0.05% and the remainder impurities and Al, and ③ Al alloy containing Zn: 5.4%, Mg: 2.5%, Cu: 1.8%, Zr: 0.09%, Fe: 0.25%, Si: 0.20% and the remainder impurities and Al.

The metals having a thickness of 250 mm were soaked for 4 hours at 465° C. and thereafter, soaked for 24 hours at 525° C., and hot rolling was conducted at a start temperature of 350° C. and a termination temperature of 220° C. to a thickness of 30 mm. The obtained cold rolled material was quenched in water immediately after solution heat treating for 40 minutes at 480° C. and applied with a permanent tensile deformation of 2%, after which an artificial aging treatment was conducted for 24 hours at 120° C.

The following Table 5 shows the influence on the micro-structure and mechanical properties of T651 material by the chemical components. The micro-structure was observed using the material after water quenching.

As will be apparent from Table 5, Example ① of the present invention has high fracture toughness and a low fatigue crack growth rate, showing excellent characteristic values, as compared with Comparative Examples ② and ③.

TABLE 5

| | Chemical Component of material | | Microstructure 1) | | Mechanical Properties of T651 material | | |
|---|---|---|---|---|---|---|---|
| | | | | | | | Fatigue 3) |
| | Fe (wt. %) | Zr (wt. %) | Distance between constituents (μm) | Size of dispersoids (Å) | Yield 2) strength LT (N/mm²) | Fracture toughness T-L (ksi√in) | crack growth rate ΔE20 ksi√in (inch/cycle) |
| ①Example 1 | 0.05 | 0.09 | 150 | 350 | 530 | 115 | $4.0 \times 10^{-5}$ |
| ②Comp. Example 1 | 0.05 | 0.03 | 150 | 150 | 525 | 105 | $8.0 \times 10^{-5}$ |
| ③Comp. Example 2 | 0.25 | 0.09 | 70 | 340 | 520 | 85 | $1.2 \times 10^{-4}$ |

1)Microstructure after water quenching
2)In compliance with ASTM E561, B646 (CT test piece)
3)In compliance with ASTM E647 (Specimen Type: CCT, R.H. ≧ 90%, R-Ratio = +0.1, frequency 1 Hz)

EXAMPLE 5

An Al alloy having the following chemical compositions ① to ③ was cast after degassing to a concentration of hydrogen 0.02 cc/100 mlAl as molten metal.

① Al alloy containing Mg: 1.0%, Si: 0.9%, Cr: 0.25%, Cu: 0.85%, Fe: 0.05% and the remainder impurities and Al, ② Al alloy containing Mg: 1.0%, Si: 0.9%, Cr: 0.10%, Cu: 0.85%, Fe: 0.05% and the remainder impurities and Al, and ③ Al alloy containing Mg: 1.0%, Si: 0.9%, Cr: 0.28%, Cu: 0.85%, Fe: 0.25% and the remainder impurities and Al.

The metals (hereinafter called "core alloy") having a thickness of 400 mm were soaked, and both surfaces of the core alloys were clad with AA1050 after both surfaces of the core alloys had been chamfered to provide a clad products having a thickness of 380 mm. The clad products were removed from a furnace immediately after heating to 380° C. and hot rolling was conducted at a start temperature of 350° C. and a termination temperature of 220° C. to a thickness of 2.5 mm followed by cold rolling to a thickness of 2.5 mm. The obtained cold rolled material was quenched in water immediately after solution heat treating for 40 minutes at 570° C. and applied with a permanent tensile deformation of 2%, after which an artificial aging treatment was conducted for 4 hours at 190° C.

The following Table 6 shows the influence on the micro-structure and mechanical properties of T651 material by the chemical components. The micro-structure was observed using the core alloys after water quenching.

As will be apparent from Table 6, Example ① of the present invention has high fracture toughness and a low fatigue crack growth rate, showing excellent characteristic values, as compared with Comparative Examples ② and ③.

TABLE 6

| | Chemical Component of core Alloy | | Microstructure of Core Alloy1) | | Mechanical Properties of Clad Product (T651) | | |
|---|---|---|---|---|---|---|---|
| | Fe (wt. %) | Cr (wt. %) | Distance between constituents (μm) | Size of dispersoids (Å) | Yield strength LT (N/mm²) | Fracture2) toughness T-L (ksi√in) | Fatigue3) crack growth rate ΔK30 ksi√in (inch/cycle) |
| ①Example 1 | 0.05 | 0.25 | 160 | 1300 | 400 | 145 | $1.5 \times 10^{-4}$ |
| ②Comp. Example 1 | 0.05 | 0.10 | 160 | 800 | 390 | 135 | $2.0 \times 10^{-4}$ |
| ③Comp. Example 2 | 0.25 | 0.28 | 80 | 1100 | 405 | 110 | $3.0 \times 10^{-4}$ |

1)Microstructure after water quenching
2)In compliance with ASTM E561, B646 (Test piece with a central hole, width of test piece; 406 mm)
3)In compliance with ASTM E647 (Specimen Type: CCT, width of test piece; 102 mm, R.H. ≧ 90%, R-Ratio = +0.1, frequency 1 Hz)

What is claimed is:

1. A heat treatable Al alloy, consisting essentially of:

(i) 1–8 wt. % Cu;

(ii) one or more members selected from the group consisting of 0.4–0.8 wt. % Mn, 0.15–0.3 wt. % Cr, 0.05–0.1 wt. % Zr and 0.1–2.5 wt. % Mg;

(iii) less than 0.1 wt. % of each Fe and Si; and (iv) a remainder of aluminum and impurity elements;

wherein a distance between intermetallic constituents formed during casting and cooling after casting of said alloy is more than 85 μm, and said alloy has a micro-structure having at least one member selected from the group consisting of (a) Al—Mn dispersoids having a size of 4,000 Å or more, and (b) Al—Cr dispersoids having a size of 1,000 Å or more, and wherein said alloy has been annealed at a temperature of 450°–485° C.

2. The alloy of claim 1, wherein said constituents are particles of compounds selected from the group consisting of $Al_7Cu_2Fe$, $Al_{12}(Fe, Mn)_3Cu_2$, $(Fe, Mn)Al_6$, $Al_2CuMg$, $Al_2Cu$ and $Mg_2Si$.

3. The alloy of claim 1, wherein said alloy has been produced by a process comprising:

casting said alloy;

annealing said alloy at a temperature 450°–485° C.;

hot rolling said alloy; and cooling said alloy.

4. The alloy of claim 3, wherein during said casting, said alloy comprises at most 0.05 cc of hydrogen/100 ml.

5. The alloy of claim 1, wherein said alloy comprises said Mg and said Mn.

6. A heat treatable Al alloy consisting essentially of:

(i) 0.1–10 wt. % Zn;

(ii) 0.1–3.5 wt. % Mg;

(iii) one or more members selected from the group consisting of 0.4–0.8 wt. % Mn, 0.15–0.3 wt. % Cr, 0.05–0.1 wt. % Zr and 0.1–3 wt. % Cu;

(iv) less than 0.1 wt. % of each Fe and Si; and (v) a remainder of aluminum and impurity elements;

wherein a distance between intermetallic constituents formed during casting and cooling after casting of said alloy is more than 85 μm, said alloy has a micro-structure having at least one member selected from the group consisting of (a) Al—Mn dispersoids having a size of 4,000 Å or more, (b) Al—Cr dispersoids having a size of 1,000 Å or more, and (c) Al—Zr dispersoids having a size of 300 Å or more, and said alloy has a fatigue crack growth rate T-L $\Delta K30ksi\sqrt{in}$, in compliance with ASTM E647, of $7.0\times10^{-5}$ inch/cycle or less.

7. The alloy of claim 6, wherein said constituents are particles of compounds selected from the group consisting of $Al_7Cu_2Fe$, $Al_{12}$ $(Fe, Mn)_3Cu_2$, $(Fe, Mn)Al_6$, $Al_2CuMg$, $Al_2Cu$ and $Mg_2Si$.

8. The alloy of claim 6, wherein said alloy has been produced by a process comprising:

casting said alloy;

annealing said alloy at a temperature 450°–530° C.;

hot rolling said alloy; and cooling said alloy.

9. The alloy of claim 8, wherein during said casting, said alloy comprises at most 0.05 cc of hydrogen/100 ml.

10. The alloy of claim 6, wherein said alloy comprises said Zr and said Cu.

* * * * *